US012569022B2

(12) United States Patent
Goulet et al.

(10) Patent No.: US 12,569,022 B2
(45) Date of Patent: Mar. 10, 2026

(54) SAFETY BAND FOR HARD HAT

(71) Applicants: Justin Goulet, Timmins (CA); Antonio Esposito, Timmins (CA)

(72) Inventors: Justin Goulet, Timmins (CA); Antonio Esposito, Timmins (CA)

( * ) Notice: Subject to any disclaimer, the term of this patent is extended or adjusted under 35 U.S.C. 154(b) by 0 days.

(21) Appl. No.: 19/200,787

(22) Filed: May 7, 2025

(65) Prior Publication Data

US 2025/0359614 A1 Nov. 27, 2025

(30) Foreign Application Priority Data

May 23, 2024 (CA) ..... 3239350

(51) Int. Cl.
*A42B 3/04* (2006.01)
*A42B 1/244* (2021.01)

(52) U.S. Cl.
CPC ..... *A42B 3/0453* (2013.01); *A42B 3/0446* (2013.01); *A42B 1/244* (2013.01)

(58) Field of Classification Search
CPC ..... A42B 1/244; A42B 3/0433; A42B 3/044; A42B 3/0446; A42B 3/0453
See application file for complete search history.

(56) References Cited

U.S. PATENT DOCUMENTS 9,271,343 B2 * 2/2016 Mackool ..... H05B 47/11
11,178,921 B2 * 11/2021 Kalata ..... A01K 13/006
2004/0227628 A1 * 11/2004 Burdick ..... A42B 3/0453 340/479
2009/0073679 A1 * 3/2009 Wainright ..... A42B 3/044 362/106
2010/0238682 A1 * 9/2010 Carpenter ..... F21V 21/084 362/555
2013/0223070 A1 * 8/2013 Baker ..... F21V 33/0076 362/244
2019/0350292 A1 * 11/2019 Maldonado ..... H05B 45/20
2022/0357023 A1 * 11/2022 Doughty ..... A42B 3/044

FOREIGN PATENT DOCUMENTS

DE 29915607 U1 * 8/2000 ..... G08B 5/004
KR 20180010083 A * 1/2018 ..... A42B 3/30
KR 20190012489 A * 2/2019 ..... F21V 21/084
KR 20190012490 A * 2/2019 ..... A42B 3/044
KR 20190142870 A * 12/2019 ..... F21L 4/027
KR 102063218 B1 * 1/2020 ..... A42B 3/044
KR 20200038902 A * 4/2020 ..... H01R 33/945

* cited by examiner

*Primary Examiner* — Alexander K Garlen
(74) *Attorney, Agent, or Firm* — Orin Del Vecchio

(57) ABSTRACT

A safety band for a hard hat is disclosed herein. In some versions, the safety band for a hard hat includes a band, a plurality of light emitting elements attached to an exterior of the band and a plurality of reflective strips attached to the exterior of the band and each alternately arranged between each of the plurality of light emitting elements. The safety band for a hard hat can be particularly useful for preventing or minimizing vehicle collisions with miners in low visibility conditions.

15 Claims, 7 Drawing Sheets

SAFETY BAND FOR HARD HAT

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of hard hats of existing art and more specifically relates to a band for illuminating a hard hat.

RELATED ART

Miners, navigating the rugged terrains of underground tunnels or harsh environments of open-pit mines, rely heavily on protective gear to mitigate the inherent risks of their profession. Among these essentials are hard hats. Constructed from durable materials like high-density polyethylene or fiberglass, these hard hats are designed to withstand impacts from falling debris, collisions, or accidental bumps, offering vital protection to miners' heads.

Vehicles are also utilized in mining operations and are indispensable tools for efficient material transport and excavation. However, in the dimly lit and often dusty environments of mines, these vehicles can pose significant dangers to miners, particularly when visibility is severely compromised. In conditions of low visibility, such as during blasting operations or in poorly illuminated areas, the risk of accidents escalates as vehicle operators struggle to spot miners and other hazards in their path. Accordingly, a suitable solution is desired.

SUMMARY OF THE INVENTION

In view of the foregoing disadvantages inherent in the known hard hat art, the present disclosure provides a novel safety band for a hard hat. The general purpose of the present disclosure, which will be described subsequently in greater detail, is to provide a band that can be attached to a hard hat and provides illumination thereto, thereby minimizing the risk of vehicle collisions with miners in low visibility conditions.

A safety band for a hard hat is disclosed herein. According to one or more embodiments, the safety band for a hard hat may include a band configured to surround a portion of the hard hat, a plurality of light emitting elements and a plurality of reflective strips. The band may include an exterior surface opposite an interior surface. The plurality of light emitting elements may be spaced equally apart around the exterior surface of the band and configured to emit a blue light; and the plurality of reflective strips may be alternately arranged between each of the plurality of light emitting elements.

According to one or more embodiments, a hard hat with safety band is also disclosed herein. The hard hat with safety band may include a hard hat and a band including an exterior surface opposite an interior surface configured to surround a portion of the hard hat. At least one light emitting element configured to emit a blue light and at least one reflective strip may each be disposed at the exterior of the band, thereby providing illumination to the band (and improving visibility of the miner wearing the hard hat).

According to one or more additional embodiments, a safety band for a hard hat may include a continuous band, a plurality of light emitting elements and a plurality of reflective strips. The continuous band may be configured to surround a portion of the hard hat and may include an exterior surface opposite an interior surface and a plurality of receiver brackets spaced equally apart around the exterior surface of the band. The plurality of light emitting elements may each be configured for insertion into one of the plurality of receiver brackets and each may include a plurality of LED lights encased in a semi-opaque light emitting element housing and configured to emit a blue flashing light. The plurality of reflective strips may each be alternately arranged between each of the plurality of light emitting elements.

Further, the continuous band may include a front side opposite a rear side and a left side opposite a right side all relative to the hard hat when attached thereto. A first reflective strip of the plurality of reflective strips may be disposed centrally at the front side of the band, a second reflective strip of the plurality of reflective strips may be disposed centrally at the rear side of the band, a third reflective strip of the plurality of reflective strips may be disposed centrally at the left side of the band, and a fourth reflective strip of the plurality of reflective strips may be disposed centrally at the right side of the band.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a safety band for hard hat, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a safety band for a hard hat. Generally, the safety band for a hard hat includes blue flashing lights disposed on a hard hat halo, providing underground safety, high visibility and bright flashing lights. As such, the safety band for a hard hat can be particularly useful for saving vehicle collisions with miners in low visibility conditions.

Referring now more specifically to the drawings by numerals of reference, there is shown in FIGS. 1-7, various views of a safety band 100 for headwear, such as a hard hat 101, according to one or more embodiments of the present disclosure.

Figure 1:
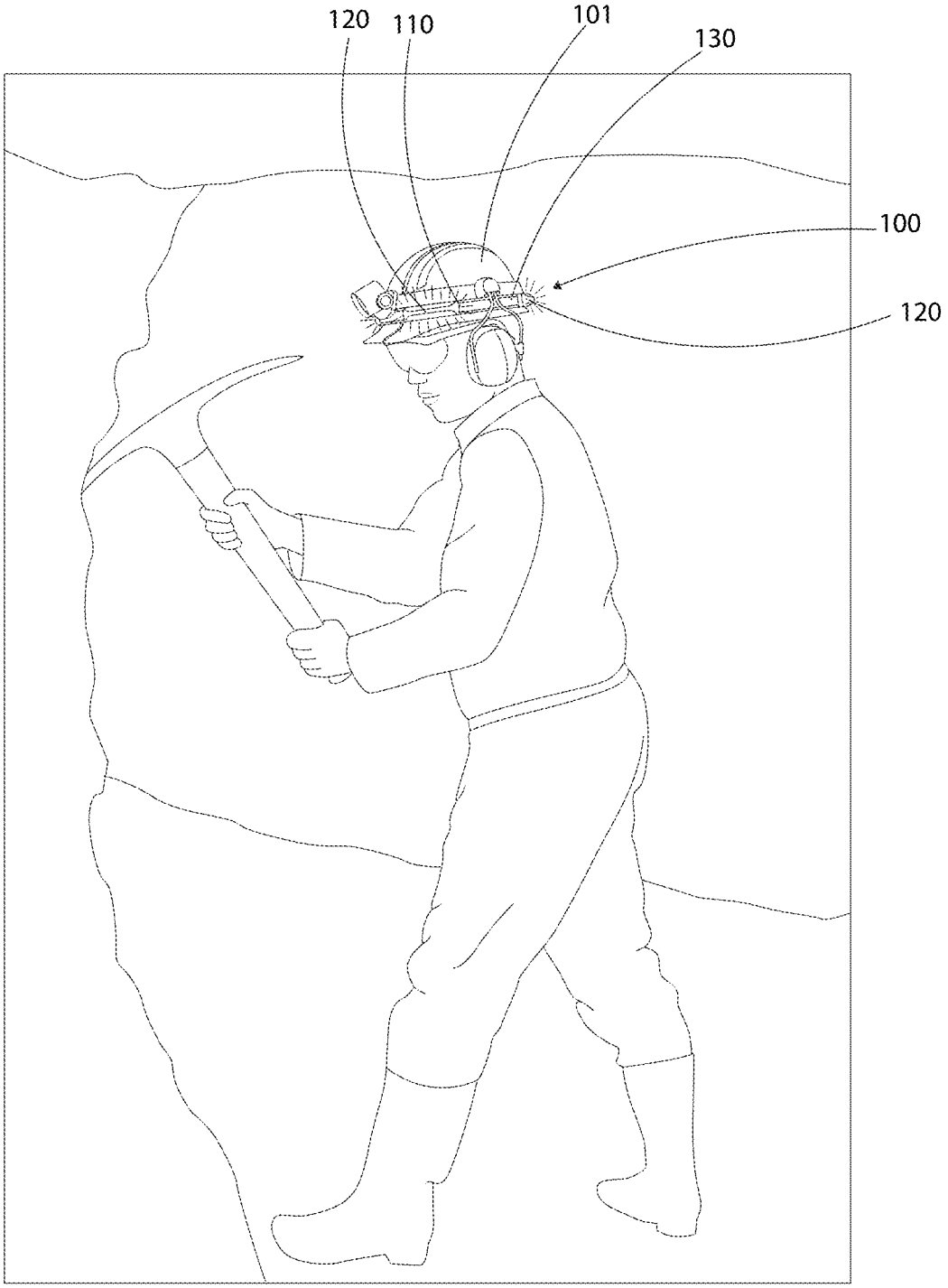
FIG. 1 is a perspective view of a safety band attached to a hard hat worn by a miner, according to an embodiment of the disclosure.

Referring first to FIG. 1, there is shown a safety band 100 in use on a hard hat 101. In some embodiments, the safety band 100 may be provided for use with existing hard hats 101. In other embodiments, the safety band 100 may be provided for use with a particular hard hat. As discussed above, the safety band 100 may be particularly worn on hard hats 101 worn by miners and provides improved visibility of the miner. As such, the risk of being struck by vehicles in the mines is prevented or at least substantially minimized. In this figure, lines have been used to demonstrate light being emitted from the safety band 100. These lines do not form part of the invention and are not meant to limit the invention in any way.

Figure 2:
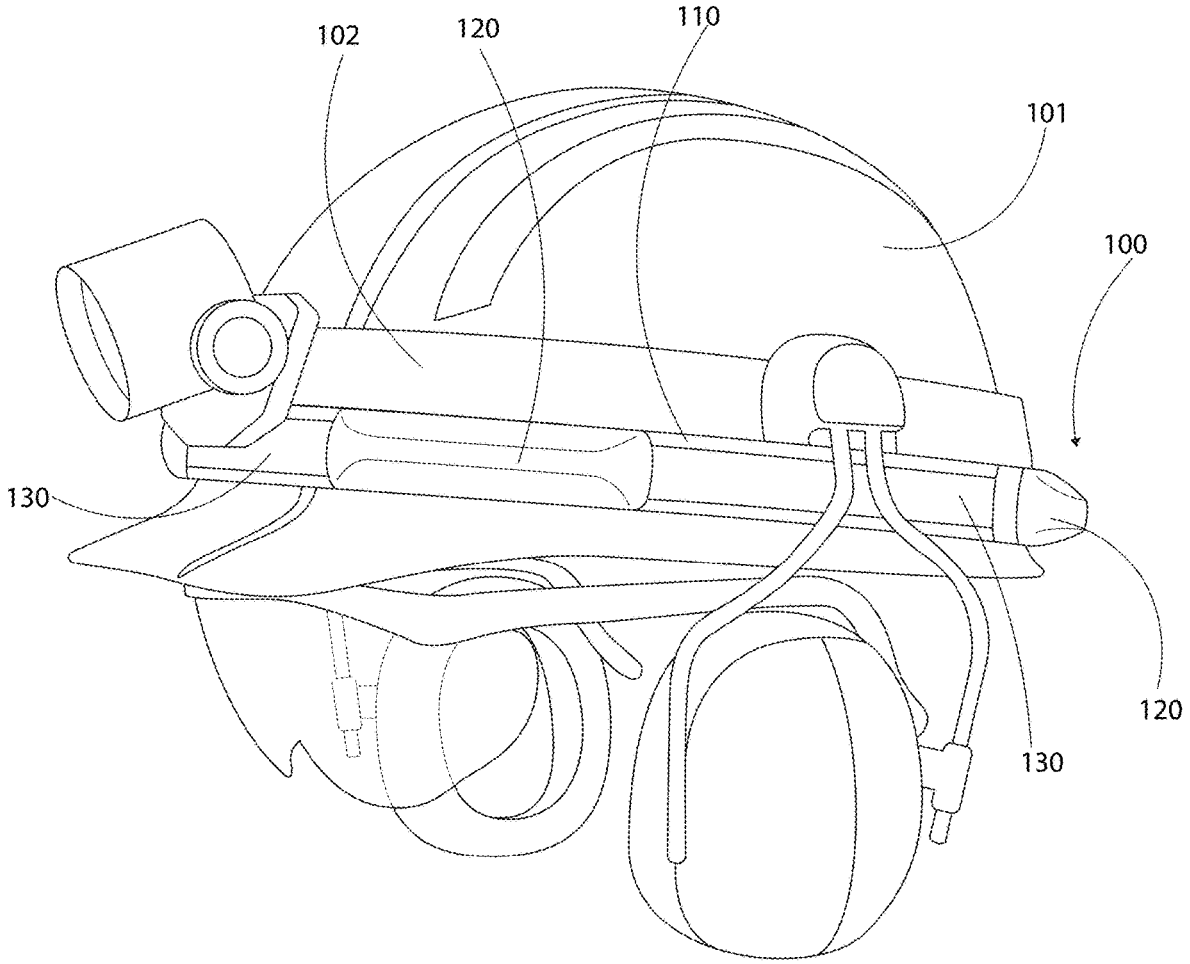
FIG. 2 is a side perspective view of the safety band attached to the hard hat, according to an embodiment of the present disclosure.
Figure 3:
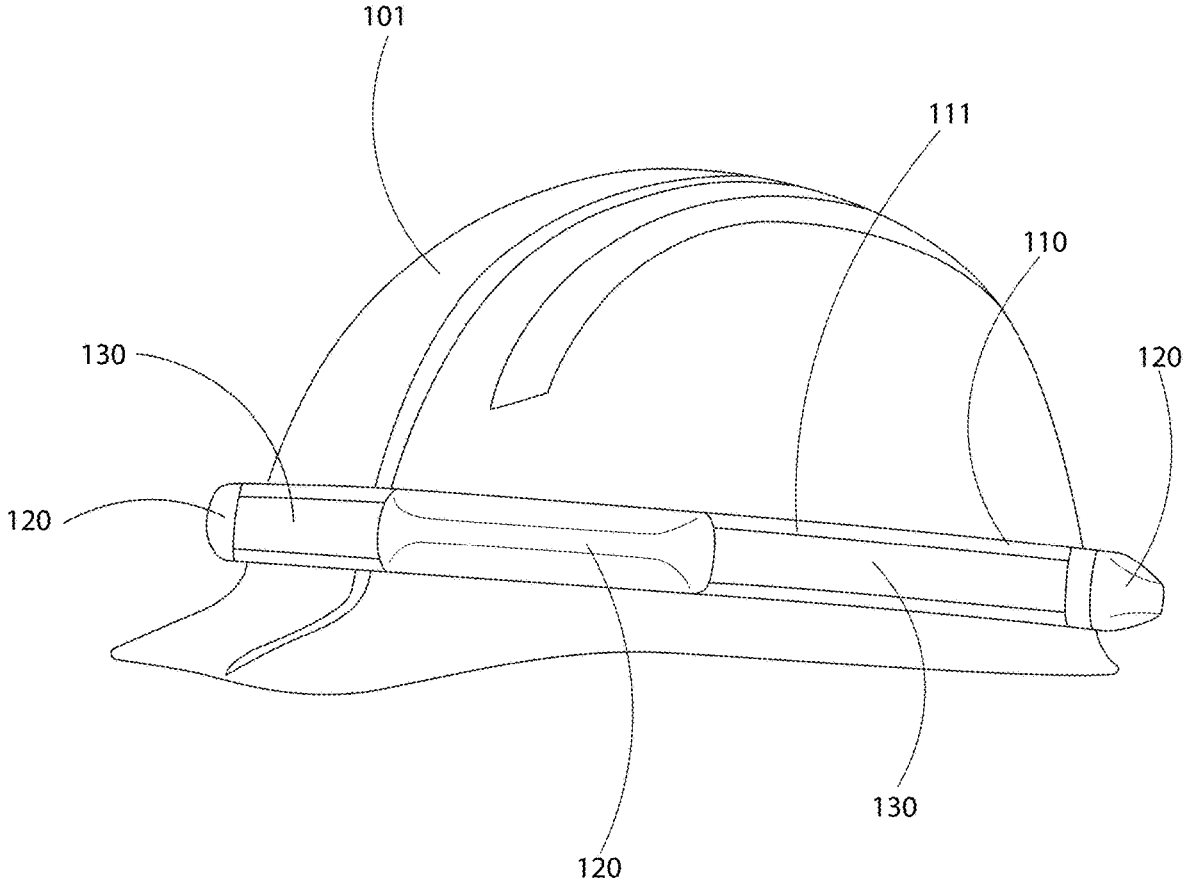
FIG. 3 is a side perspective view of the safety band attached to the hard hat and including a band, a plurality of light emitting elements and a plurality of reflective strips, according to an embodiment of the present disclosure.
Figure 4:
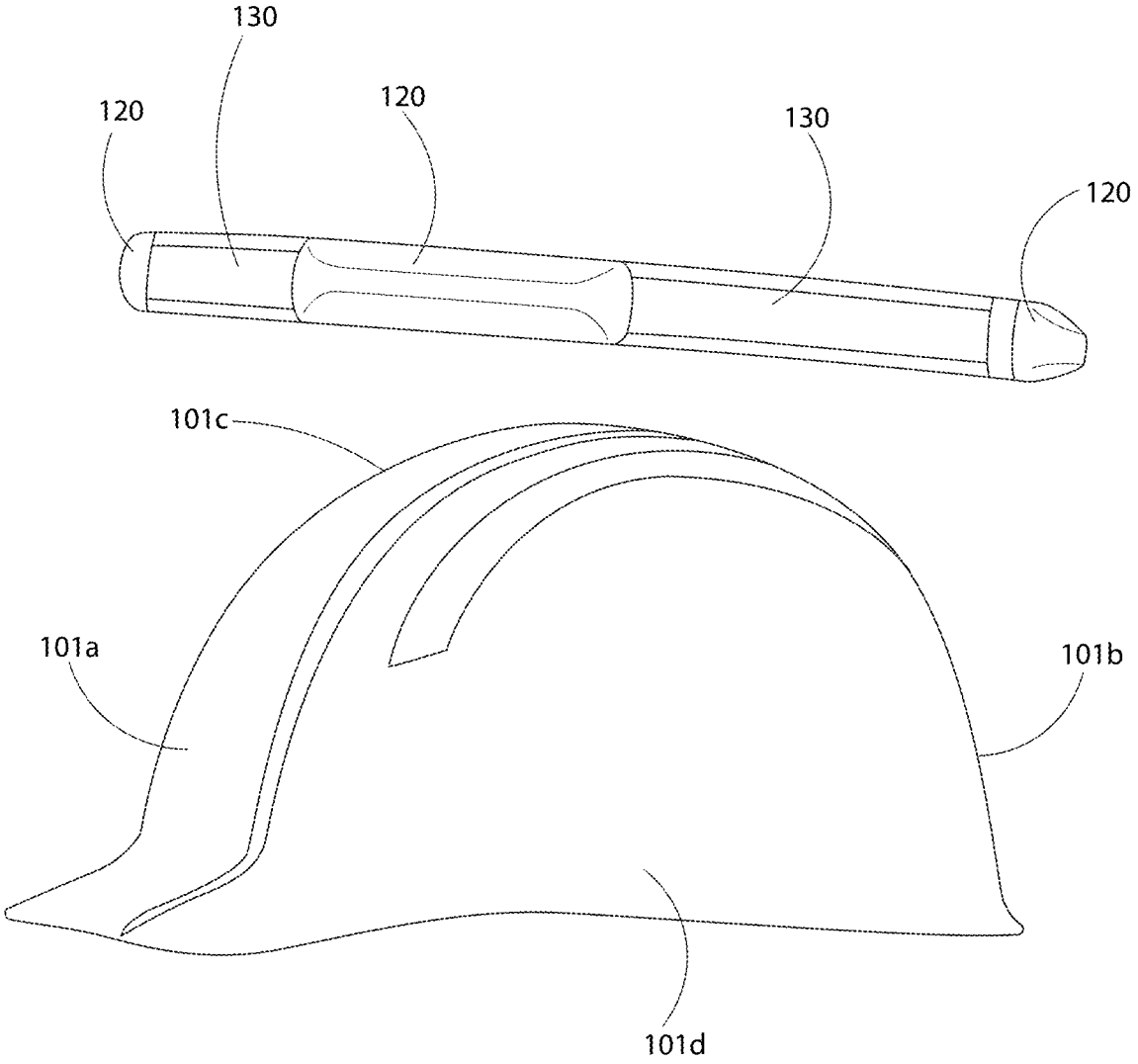
FIG. 4 is a side perspective view of the safety band removed from the hard hat, according to an embodiment of the present disclosure.
Figure 5A:
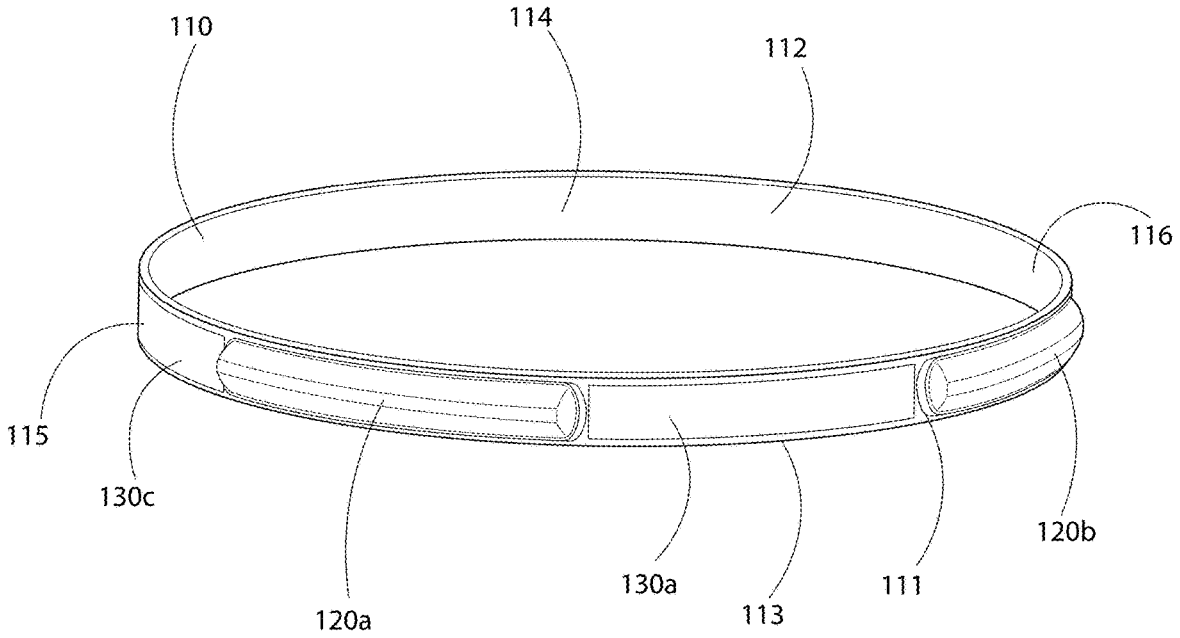
FIG. 5A is a front perspective view of the safety band, according to an embodiment of the present disclosure.
Figure 5B:
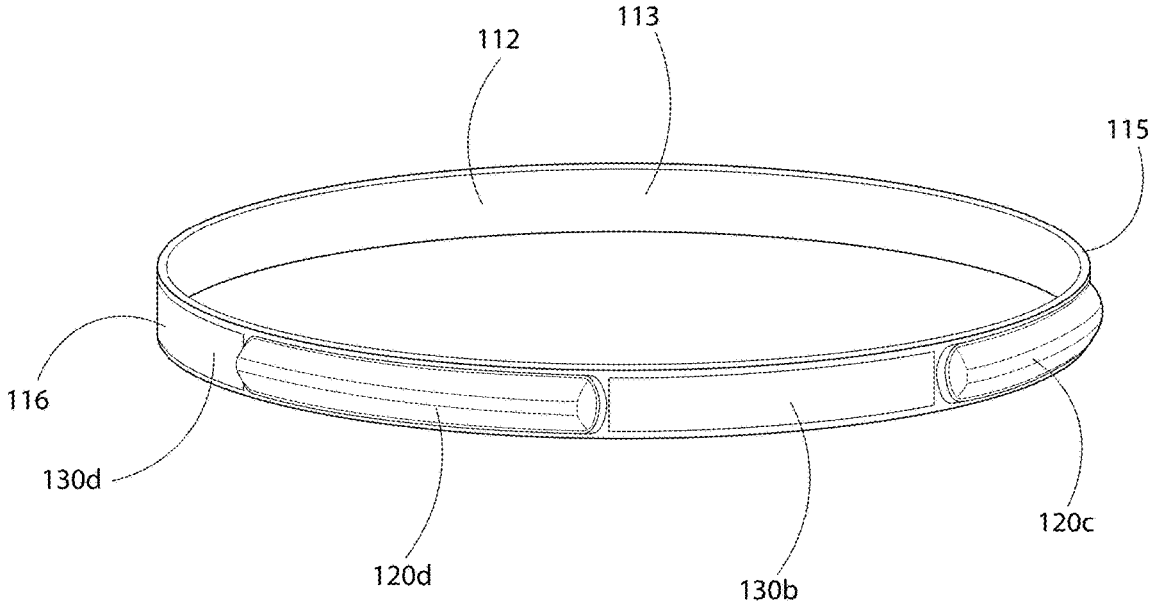
FIG. 5B is a rear perspective view of the safety band, according to an embodiment of the present disclosure.
Figure 6A:
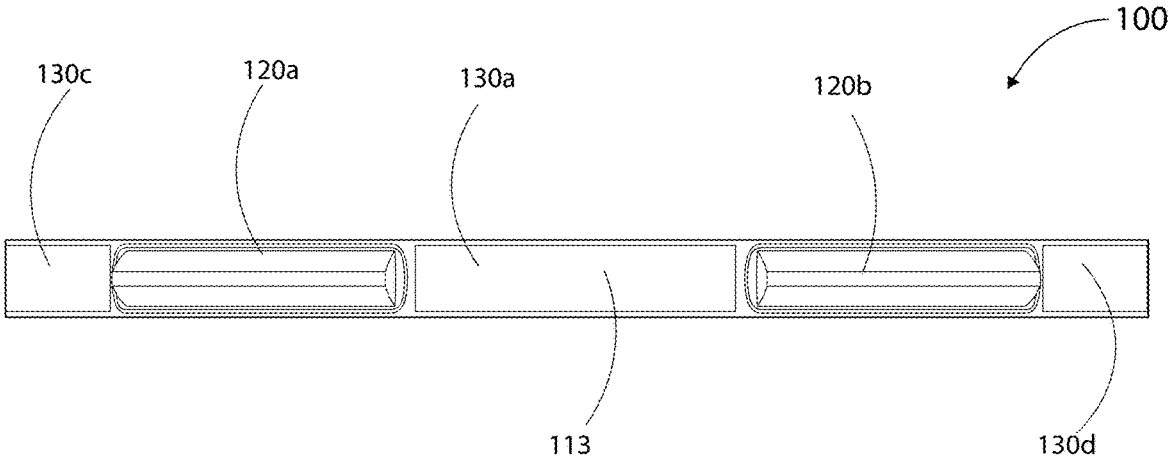
FIG. 6A is a front view of the safety band, according to an embodiment of the present disclosure.
Figure 6B:
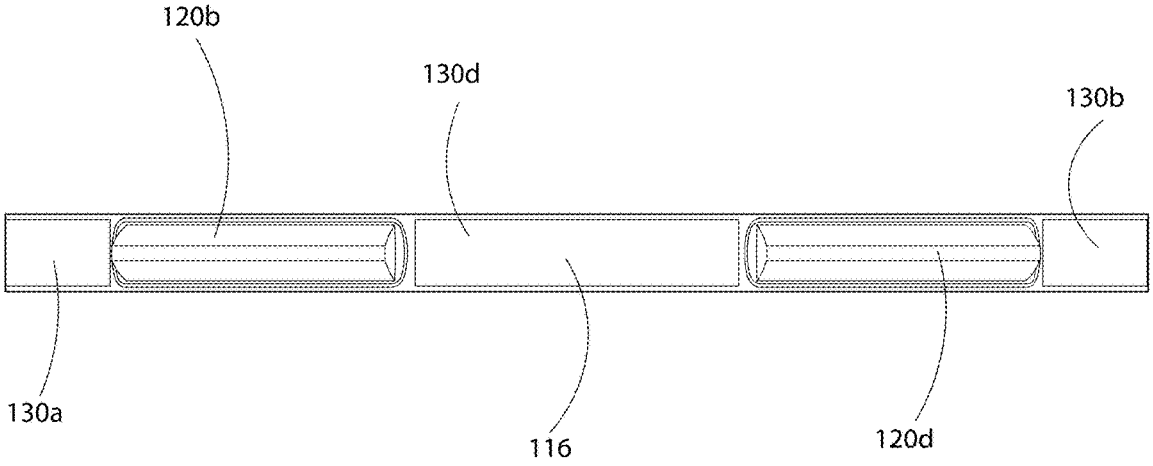
FIG. 6B is a right side view of the safety band, according to an embodiment of the present disclosure.

Referring now to FIGS. 2-4, there are shown various views of the safety band 100 attached, or being attached to, the hard hat 101, according to one or more embodiments of the present disclosure. As shown in FIGS. 2-3 in particular, the band 110 may be configured to surround a portion of the hard hat 101. Particularly, the band 110 may be configured to surround a lower portion of the hard hat 101, for example, at the widest portion of the hard hat 101.

As shown in FIG. 2 in particular, the safety band 100 may be attached underneath a lighting device and headphone assembly 102 commonly worn by miners on the hard hat 101. This may prevent the safety band 100 from coming loose or falling off of the hard hat 101. In some embodiments, the band 110 may be a continuous loop. As such, the band 110 may include a degree of flexibility to enable the band 110 to be stretched around the hard hat 101 and conform therearound.

Referring also now to FIGS. 5A-6B with reference still to FIGS. 2-4, the band 110 may include an exterior surface 111 opposite an interior surface 112. In some embodiments, at least one light emitting element 120 may be attached to the exterior surface 111. In particular, as shown here, a plurality of light emitting elements 120 may be spaced equally apart around the exterior surface 111 of the band 110. Preferably, the plurality of light emitting elements 120 may be configured to emit a blue light. In particular, the plurality of light emitting elements 120 may each be configured to flash the blue light at regular intervals. The flashing blue light may be consistent so as to provide the improved visibility to the miner necessary to avoid vehicle collisions.

In addition, at least one reflective strip 130 may further be attached to the exterior surface 111 of the band 110. Particularly, as shown in FIGS. 5A-6B, the at least one reflective strip 130 may include a plurality of reflective strips 130 configured to provide further visibility to the miner. As shown here, in some embodiments, the plurality of reflective strips 130 may each be alternately arranged between each of the plurality of light emitting elements 120 (e.g., a light emitting element 120 is followed by a reflective strip 130, and vice versa).

In particular, in some embodiments, the band 110 may include a front side 113 opposite a rear side 114, and a left side 115 opposite a right side 116, all relative to the hard hat 101 when attached thereto. In other words, the front side 113 of the band 110 should be oriented at a front side 113 of the hard hat 101 when attached thereto.

As shown in FIGS. 5A-6B, a first reflective strip 130*a* of the plurality of reflective strips 130 may be disposed centrally at the front side 113 of the band 110, a second reflective strip 130*b* of the plurality of reflective strips 130 may be disposed centrally at the rear side 114 of the band 110, a third reflective strip 130*c* of the plurality of reflective strips 130 may be disposed centrally at the left side 115 of the band 110, and a fourth reflective strip 130*d* of the plurality of reflective strips 130 may be disposed centrally at the right side 116 of the band 110.

Further, as also shown here and discussed above, each light emitting element 120 is followed by a reflective strip 130, and vice versa. In other words, each reflective strip 130 may be located between two light emitting elements 120. As such, when worn on the hard hat 101, the first reflective strip 130*a* may be located centrally at the front side of the hard hat 101 and a first and second light emitting element (120*a* and 120*b*, respectively) may be disposed either side of the first reflective strip 130*a*. Further, the second reflective strip 130*b* may be located centrally at a rear side of the hard hat 101, and third and fourth light emitting elements (120*c* and 120*d*, respectively) may be disposed either side of the second reflective strip 130*b*.

As such, the third reflective strip 130*c* may be located at a left side of the hard hat 101 and located between the first and third light emitting elements (120*a* and 120*c*, respectively); and the fourth reflective strip 130*d* may be located at a right side of the hard hat 101 and located between the second and fourth light emitting elements (120*b* and 120*d*, respectively). As shown in FIGS. 5A-6B, each side 113, 114, 115, 116 of the band 110 may be mirror images of each other as the band 110 is, according to some embodiments, contemplated to be a continuous band with equal amounts of light emitting elements 120 and reflective strips 130 alternately arranged in sequence. For example, four light emitting elements 120 and four reflective strips 130 are shown here. However, the light emitting elements 120 and the reflective strips 130 are not limited to four each.

Figure 7:
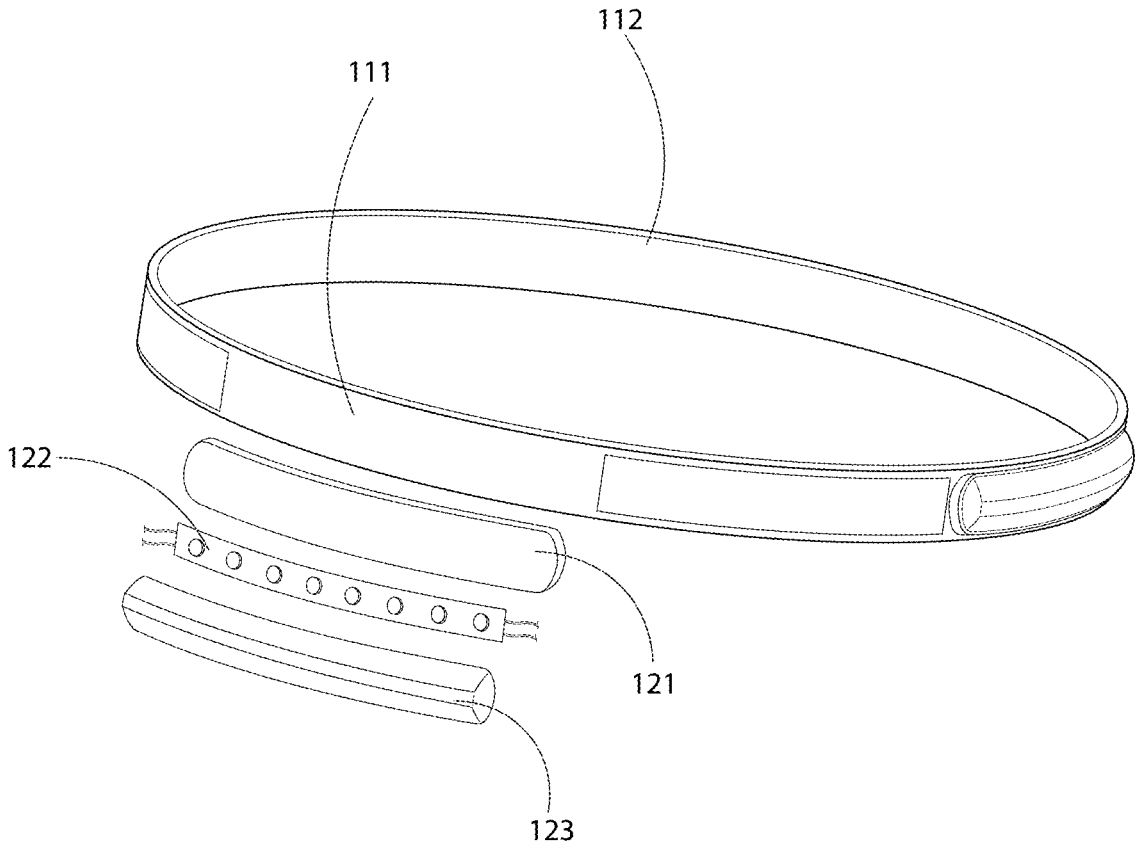
FIG. 7 is a partially exploded view of the safety band including a receiver bracket to receive a light emitting element, the light emitting element including a plurality of LED lights and a light emitting element housing, according to an embodiment of the present disclosure.

Referring now more specifically to FIG. 7, there is shown a perspective exploded view of the safety band 100, according to one or more embodiments of the present disclosure. In particular, one of the light emitting elements 120 is exploded from the band 110 here. As shown here, the band 110 may include a plurality of receiver brackets 121 for receiving one of the plurality of light emitting elements 120 therein. In other words, each receiver brackets 121 receives one light emitting element 120 and attaches it to the exterior surface 111 of the band 110. In some embodiments, the plurality of receiver brackets 121 may each be permanently fixed to the exterior surface 111 of the band 110. For example, the plurality of receiver brackets 121 may each be (but are not limited to being) glued to the exterior surface 111 of the band 110, sewn into the exterior surface 111 of the band 110, or the like.

Further, as shown in FIG. 7, the plurality of light emitting elements 120 may each include a plurality of LED (light emitting diode) lights 122 encased in a light emitting element housing 123. In some embodiments, the light emitting element housing 123 may be blue in color. In this embodiment, the blue light emitted from each of the plurality of light emitting elements 120 may come directly from the LED lights 122, from the color of the light emitting element housing 123, or both. Further, the light emitting element housing 123 may be semi-opaque, enabling the plurality of LED lights 122 to be seen through the light emitting element housing 123. In some embodiments, the light emitting element housing 123 may be constructed from a hard plastic and/or any material similar to that of the hard hat 101 to provide durability and prevent damage to the plurality of light emitting elements 120.

Further, in some embodiments, the light emitting element housing 123 may include a prism-like shape that protrudes from the exterior of the band 110. The prism shape of the light emitting element housing 123 may intensify the flashing lights of the plurality of light emitting elements 120.

In some embodiments, as shown here, the plurality of LED lights 122 may include a strip of LED lights including wiring for electrical connection with a circuitry (not illustrated). In some embodiments, the circuitry may be integral to, and disposed in, the band 110. Further, a power source (not illustrated) may in some embodiments be integral to the band 110. For example, the band 110 may include a rechargeable battery disposed therein. In other embodiments, the power source may be removable from the band 110. For example, in some embodiments, the band 110 may include a battery compartment (not illustrated) for receiving dry cell batteries, such as AA or AAA batteries to complete the circuitry and provide power to the plurality of light emitting elements 120. In other examples, the power source may include an external battery pack configured for connection to the circuitry in the band 110.

It should be noted that, under appropriate circumstances, considering such issues as design preference, user preferences, marketing preferences, cost, structural requirements, available materials, technological advances, etc., other methods are taught herein.

It should be understood by one of skill in the art that the disclosed invention is described here in a few exemplary embodiments of many. No particular terminology or description should be considered limiting on the disclosure or the scope of any claims issuing therefrom.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the relevant patent offices and the public generally, and especially the scientist, engineers and practitioners in the art who are not familiar with patent or legal terms or phraseology, to determine quickly from a cursory inspection the nature and essence of the technical disclosure of the application.

What is claimed is:

1. A safety band for a hard hat comprising:

a band including an exterior surface opposite an interior surface, the band configured to surround a portion of the hard hat;

a plurality of light emitting elements spaced equally apart around the exterior surface of the band and configured to emit a blue light; and a plurality of reflective strips each alternately arranged between each of the plurality of light emitting elements;

wherein the plurality of light emitting elements each include a light emitting diode light strip encased in a light emitting element housing, the light emitting element housing includes a prism shape protruding outwardly from the exterior surface of the band and transmitting the blue light therethrough.

2. The safety band for a hard hat of claim 1, wherein the plurality of light emitting elements are each configured to flash the blue light.

3. The safety band for a hard hat of claim 2, wherein the band includes a plurality of receiver brackets for receiving one of the plurality of light emitting elements therein.

4. The safety band for a hard hat of claim 3, wherein the light emitting element housing is semi-opaque.

5. The safety band for a hard hat of claim 4, wherein the light emitting element housing is made from a hard plastic.

6. The safety band for a hard hat of claim 1, wherein the band includes a front side opposite a rear side and a left side opposite a right side all relative to the hard hat when attached thereto, and wherein a first reflective strip of the plurality of reflective strips is disposed centrally at the front side of the band, a second reflective strip of the plurality of reflective strips is disposed centrally at the rear side of the band, a third reflective strip of the plurality of reflective strips is disposed centrally at the left side of the band, and a fourth reflective strip of the plurality of reflective strips is disposed centrally at the right side of the band.

7. The safety band for a hard hat of claim 6, wherein the band is a continuous loop.

8. A hard hat with safety band comprising:

a hard hat;

a band including an exterior surface opposite an interior surface, the band configured to surround a portion of the hard hat;

at least one light emitting element disposed at the exterior of the band and configured to emit a blue light; and at least one reflective strip disposed at the exterior of the band;

wherein the at least one light emitting element includes a plurality of light emitting elements, the at least one reflective strip includes a plurality of reflective strips each alternately arranged between each of the plurality of light emitting elements, the plurality of light emitting elements each include a light emitting diode light strip encased in a light emitting element housing, and the light emitting element housing includes a prism shape protruding outwardly from the exterior surface of the band and transmitting the blue light therethrough.

9. The hard hat with safety band of claim 8, wherein the plurality of light emitting elements are each configured to flash the blue light.

10. The hard hat with safety band of claim 9, wherein the band includes a plurality of receiver brackets for receiving one of the plurality of light emitting elements therein.

11. The hard hat with safety band of claim 10, wherein the light emitting element housing is semi-opaque.

12. The hard hat with safety band of claim 11, wherein the light emitting element housing is made from a hard plastic.

13. The hard hat with safety band of claim 8, wherein the band includes a front side opposite a rear side and a left side opposite a right side all relative to the hard hat when attached thereto, and wherein a first reflective strip of the plurality of reflective strips is disposed centrally at the front side of the band, a second reflective strip of the plurality of reflective strips is disposed centrally at the rear side of the band, a third reflective strip of the plurality of reflective strips is disposed centrally at the left side of the band, and a fourth reflective strip of the plurality of reflective strips is disposed centrally at the right side of the band.

14. The hard hat with safety band of claim 13, wherein the band is a continuous loop.

15. A safety band for a hard hat comprising:

a continuous band including an exterior surface opposite an interior surface, the band configured to surround a portion of the hard hat, the continuous band including a plurality of receiver brackets spaced equally apart around the exterior surface of the band;

a plurality of light emitting elements each configured for insertion into one of the plurality of receiver brackets, the plurality of light emitting elements each including a plurality of light emitting diode lights encased in a semi-opaque light emitting element housing and configured to emit a blue flashing light, each light emitting element housing includes a prism shape which protrudes outwardly from the exterior surface of the band and transmits the blue flashing light therethrough; and a plurality of reflective strips each alternately arranged between each of the plurality of light emitting elements; and wherein the continuous band includes a front side opposite a rear side and a left side opposite a right side all relative to the hard hat when attached thereto, and wherein a first reflective strip of the plurality of reflective strips is disposed centrally at the front side of the band, a second reflective strip of the plurality of reflective strips is disposed centrally at the rear side of the band, a third reflective strip of the plurality of reflective strips is disposed centrally at the left side of the band, a fourth reflective strip of the plurality of reflective strips is disposed centrally at the right side of the band.

* * * * *